United States Patent [19]

Kawamata

[11] Patent Number: 4,868,553

[45] Date of Patent: Sep. 19, 1989

[54] RASTER OPERATION DEVICE

[75] Inventor: Yoshio Kawamata, Hitachi, Japan

[73] Assignee: Hitachi, Ltd., Tokyo, Japan

[21] Appl. No.: 111,626

[22] Filed: Oct. 23, 1987

[30] Foreign Application Priority Data

Oct. 25, 1986 [JP] Japan ..... 61-254333

[51] Int. Cl.[4] ..... G09G 1/06

[52] U.S. Cl. ..... 340/731; 340/748; 340/750

[58] Field of Search ..... 340/731, 723, 748, 750, 340/735; 364/518, 519

[56] References Cited

U.S. PATENT DOCUMENTS

| | | | |
|---|---|---|---|
| 4,107,786 | 8/1978 | Masaki et al. | 340/731 |
| 4,283,724 | 8/1981 | Edwards | 340/731 |
| 4,367,533 | 1/1983 | Wiener | 340/731 |
| 4,682,161 | 7/1987 | Bugg | 340/731 |

FOREIGN PATENT DOCUMENTS 260989 12/1985 Japan .

OTHER PUBLICATIONS

"256K Graphic Dual-Port Memory Incorporating, Raster Operation Function and Serial Input Function", Nikkei Electronics, pp. 243-264, 3-86.

*Primary Examiner*—Gerald L. Brigance
*Assistant Examiner*—Edwin C. Holloway, III
*Attorney, Agent, or Firm*—Antonelli, Terry & Wands

[57] ABSTRACT

Disclosed is a raster operation device including a word boundary checking circuit which operates on a hardware basis to check as to whether the writing of data across the word boundary of frame buffer occurs, basing on the shift width, bit width, etc. of data to be written from CPU to frame buffer; an address generation circuit which operates on a hardware basis to provide the frame buffer with the next address adjacent in the word boundary direction to the address of frame buffer specified for writing by the CPU; and a sequence control circuit which operates on a hardware basis to control in read-modify-write mode the writing of data in the address specified by the CPU when the writing data is found not to cross the word boundary, or to control in read-modify-write mode the writing of data in the address specified by the CPU and, thereafter, control in read-modify-write mode the writing of bit data which has been left unwritten in the address specified by the CPU into the next address adjacent in the word boundary direction issued by the address generation circuit, basing on a single writing instruction issued by the CPU to the frame buffer.

5 Claims, 18 Drawing Sheets

CYCLE END SIGNAL
WRITE SIGNAL
OUTPUT CONTROL SIGNAL
READ SIGNAL
LATCH SIGNAL
WRITE AREA SPECIFYING SIGNAL
SELECTION SIGNAL
712
708
616
707
611
613
711
CYCLE END SIGNAL GENERATION CIRCUIT
WRITE TIMING GENERATION CIRCUIT
READ TIMING GENERATION CIRCUIT
753
752
751
754
D
Q
F.F.
CK
CLR
Vcc
756
755
757
750
CLR
STEP 4
STEP 3
STEP 2
STEP 1
MODE COUNTER
704
612
710
BOUNDARY DETECT SIGNAL
MEMORY WRITE SIGNAL

FIG. 14A

| INPUT VALUE WN | OUTPUT DATA OF BASE PATTERN GENERATION CIRCUIT 805 | | | | | | | | | | | | | | | |
|---|---|---|---|---|---|---|---|---|---|---|---|---|---|---|---|---|
| | 16 BITS | | | | | | | | | | | | | | | |
| | P0 | P1 | P2 | P3 | P4 | P5 | P6 | P7 | P8 | P9 | P10 | P11 | P12 | P13 | P14 | P15 |
| 1 | 1 | 0 | 0 | 0 | 0 | 0 | 0 | 0 | 0 | 0 | 0 | 0 | 0 | 0 | 0 | 0 |
| 2 | 1 | 1 | 0 | — | — | — | — | — | — | — | — | — | — | — | — | 0 |
| 3 | 1 | 1 | 1 | 0 | — | — | — | — | — | — | — | — | — | — | — | 0 |
| 4 | 1 | 1 | 1 | 1 | 0 | — | — | — | — | — | — | — | — | — | — | 0 |
| 5 | 1 | 1 | 1 | 1 | 1 | 0 | — | — | — | — | — | — | — | — | — | 0 |
| 6 | 1 | 1 | 1 | 1 | 1 | 1 | 0 | — | — | — | — | — | — | — | — | 0 |
| 7 | 1 | 1 | 1 | 1 | 1 | 1 | 1 | 0 | — | — | — | — | — | — | — | 0 |
| 8 | 1 | 1 | 1 | 1 | 1 | 1 | 1 | 1 | 0 | — | — | — | — | — | — | 0 |
| 9 | 1 | 1 | 1 | 1 | 1 | 1 | 1 | 1 | 1 | 0 | — | — | — | — | — | 0 |
| 10 | 1 | 1 | 1 | 1 | 1 | 1 | 1 | 1 | 1 | 1 | 0 | — | — | — | — | 0 |
| 11 | 1 | 1 | 1 | 1 | 1 | 1 | 1 | 1 | 1 | 1 | 1 | 0 | — | — | — | 0 |
| 12 | 1 | 1 | 1 | 1 | 1 | 1 | 1 | 1 | 1 | 1 | 1 | 1 | 0 | 0 | 0 | 0 |
| 13 | 1 | 1 | 1 | 1 | 1 | 1 | 1 | 1 | 1 | 1 | 1 | 1 | 1 | 0 | 0 | 0 |
| 14 | 1 | 1 | 1 | 1 | 1 | 1 | 1 | 1 | 1 | 1 | 1 | 1 | 1 | 1 | 0 | 0 |
| 15 | 1 | 1 | 1 | 1 | 1 | 1 | 1 | 1 | 1 | 1 | 1 | 1 | 1 | 1 | 1 | 0 |
| 16 | 1 | 1 | 1 | 1 | 1 | 1 | 1 | 1 | 1 | 1 | 1 | 1 | 1 | 1 | 1 | 1 |

FIG. 14B

| INPUT VALUE BN-DN | OUTPUT DATA OF MASK PATTERN GENERATION CIRCUIT 806 | |
|---|---|---|
| | LOW-ORDER 16 BITS | HIGH-ORDER 16 BITS |
| | BIT 0 1 2 3 4 5 6 7 8 9 10 11 12 13 14 BIT 15 | BIT 16 17 18 19 20 21 22 23 24 25 26 27 28 29 30 BIT 31 |
| 16 | p0 p1 p2 p3 p4 p5 p6 p7 p8 p9 p10 p11 p12 p13 p14 p15 | 0 — 0 |
| 15 | 0 p0 p1 p2 p3 p4 p5 p6 p7 p8 p9 p10 p11 p12 p13 p14 | p15 0 — 0 |
| 14 | 0 0 p0 — | p15 0 — 0 |
| 13 | 0 — 0 p0 — | p15 0 — 0 |
| 12 | 0 — 0 p0 — | p15 0 — 0 |
| 11 | 0 — 0 p0 — | p15 0 — 0 |
| 10 | 0 — 0 p0 — | p15 0 — 0 |
| 9 | 0 — 0 p0 p1 p2 p3 p4 p5 p6 p7 p8 | p9 p10 p11 p12 p13 p14 p15 0 — 0 |
| 8 | 0 — 0 p0 — | p15 0 — 0 |
| 7 | 0 — 0 p0 — | p15 0 — 0 |
| 6 | 0 — 0 p0 — | p15 — 0 |
| 5 | 0 — 0 p0 — | p15 0 — 0 |
| 4 | 0 — 0 p0 — | p15 0 — 0 |
| 3 | 0 — 0 p0 — | p15 0 — 0 |
| 2 | 0 — 0 p0 — | p15 0 0 |
| 1 | 0 — 0 p0 | p15 0 |

RASTER OPERATION DEVICE

BACKGROUND OF THE INVENTION

This invention relates to a raster operation device, and more particularly to a raster operation device with a fast graphic process ability for use in display units and printers using bit map memories.

Conventionally, many of character display units used for word processors and the like have adopted the code refreshing system, and these units are now required to have a graphic display ability for displaying graphs and figures. However, when the graphics-oriented bit map refreshing system is employed, it must expand dot patterns of characters in the bit map memory in display characters, resulting in a drawback of slower display process as compared with the conventional code refreshing system. This situation holds true in the case of printing the mixture of character, graphic and image data with a laser beam printer (LBP).

A method of the fast character dot pattern expansion process for a bit map memory is described, for example, in JP-A No. 60-260989 and in article entitled "256K Graphic Dual-Port Memory Incorporating Raster Operation Function and Serial Input Function", NIKKEI ELECTRONICS, pp. 243–264, published on Mar. 24, 1986 by NIKKEI McGRAW-HILL The above patent application and article propose the provision of a logical operation circuit for dealing with the raster operation on a hardware basis, in which data to be written into the bit map memory is shifted bitwise, logical operations are implemented between data in the bit map memory and writing data which has been shifted bitwise, and the result is stored in the bit map memory.

Supporting the case of reading out data from a character generator (CG) ROM which stores dot patterns of characters and writing the data into a frame buffer made of bit memory, it can be said that the word boundaries of data stored in the CG-ROM are generally inconsistent with the word boundaries of the frame buffer. On this account, in writing data into the frame buffer, the bit-shift process for aligning writing data to the word boundaries of frame buffer is required. Generally, data written in one address of the frame has a bit width smaller that the bit width of one word of the frame buffer. For example, in writing a piece of 12-bit source data which has been shifted by 7 bits into a frame buffer of 1-word (16-bit) size, the bit width of data which is actually written in an address of frame buffer is:

$$16 \text{ bits} - 7 \text{ bits} = 9 \text{ bits}$$

The remaining 3 bits of source data which have been left unwritten in the above writing process will undergo the writing process at the next address adjacent in the word boundary direction.

The conventional system first checks whether writing data crosses the word boundary of frame buffer and, in this case, implements on a software basis the process of writing the remaining portion of data into the next address adjacent in the word boundary direction, leaving the room of improvement from the viewpoint of fast graphic processing.

SUMMARY OF THE INVENTION

The present invention is intended for the foregoing subject, and its prime object is to provide a raster operation system which implements data writing into the frame buffer on a hardware basis without the need of software-based checking as to whether writing data crosses the word boundary of frame buffer, thereby accomplishing a faster graphic process.

The above objective is achieved by the raster operation device that comprises a boundary check means which checks on a hardware basis as to whether data to be written from CPU into frame buffer crosses the boundary of frame buffer, basing on the shift width, bit width, etc. of the data; an address generation means which provides on a hardware basis the next address adjacent in the word boundary direction for the frame buffer, basing on the frame buffer address which has been pointed for data writing by the CPU; and a sequence control means which controls on a hardware basis in read-modify-write mode the writing of data into the address pointed by CPU when the data is found not to cross the word boundary, or controls in read-modify-write mode the writing of data into the address pointed by CPU and thereafter controls in read-modify-write mode the writing of bit data, which has been left unwritten in the pointed address, into the next address adjacent in the word boundary direction issued by the address generation means when the data is found to cross the word boundary, basing on a single write instruction issued by CPU to frame buffer.

The boundary check means checks the occurrence of data writing across the word boundary of frame buffer, basing on the shift width, bit width, etc. of the data to be written into the frame buffer. The address generation means provides the next address adjacent in the word boundary direction for the frame buffer, basing on the address of frame buffer pointed for writing by CPU. The sequence control means operates on the address generation means to generate the next address adjacent in the word boundary direction when data writing across the word boundary occurs, and implements rewriting into the adjoining address the data which has been left unwritten in the address pointed by CPU. This system arrangement allows direct data writing on a hardware basis without the need of recognizing the word boundary of frame buffer on a software basis, whereby faster graphic processing is accomplished.

BRIEF DESCRIPTION OF THE DRAWINGS

FIGS. 14A, 14B and 14C are diagrams showing output data of the functional blocks in the bit position determination circuit;

DESCRIPTION OF THE PREFERRED EMBODIMENT

The inventive raster operation device will now be described in detail with reference to the drawings by taking an example of the case in which the device is applied to a word processor.

Figure 2:
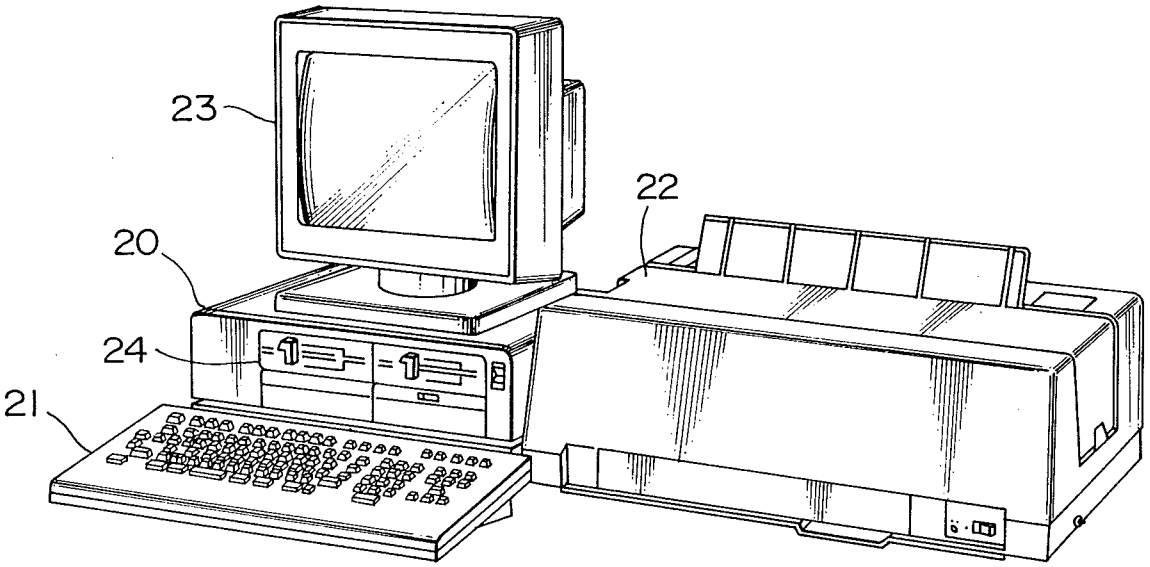
FIG. 2 is a perspective view of a word processor.
Figure 3:
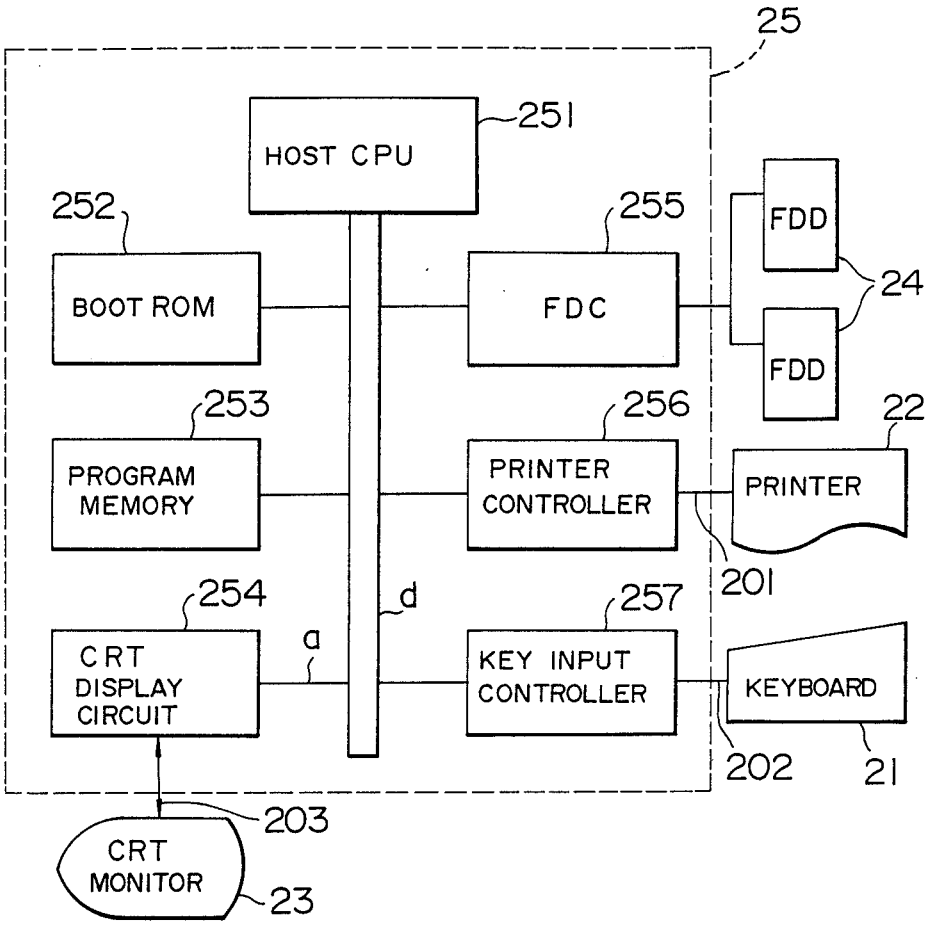
FIG. 3 is a block diagram showing the internal arrangement of the word processor.

The word processor to which the inventive raster operation device is applied consists of a main unit 20 including a temporary memory and a controller, a keyboard 21 as an input unit, a printer as a printing unit, and a CRT monitor 23 as a display unit as shown in FIG. 2. These main unit 20, printer 22, keyboard 21 and CRT monitor 23 are connected through cables 201, 202 and 203 for exchanging the control signals and information signals as shown in FIG. 3. Indicated by 24 in FIGS. 2 and 3 is a flexible disk drive unit (FDD).

The main unit 20 incorporates a controller 25 which is defined by the dashed line in the block diagram of FIG. 3. The controller 25 includes a host central processing unit (CPU) 251, a nonvolatile read-only memory (ROM) 252 which is the boot ROM containing the program executed when the system is turned on, a random-access read/write memory (RAM) 253 which is the program memory containing a word processor program and other information, a CRT display circuit 254 which produces a display pattern and provides the display signal for the CRT monitor 23 in accordance with the command from the CPU 251, a flexible disk controller (FDC) 255 which controls the FDD 24 in accordance with the command from the CPU 251, a printer controller 256 which transfers the print control signal and print data to the printer 22 in accordance with the command from the CPU 251 and also transfers the printer status signal from the printer 22 to the CPU 251, a key input controller 257 which controls the keyboard 21 in accordance with the command from the CPU 251 and also transfers input signals from the keyboard 21 to the CPU 251, and an internal signal bus d which links the CPU 251, boot ROM 252, program memory 253, CRT display controller 254, FDC 255, printer controller 256, and key input controller 257.

The FDD 24 operates to drive a flexible disk which is a magnetic recording medium, record information on the flexible disk, and retrieve information from the flexible disk. There is provided an opening for the temporary memory FDD 24 in the front of the main unit 20 as shown in FIG. 2.

Next, the operation of the overall word processor will be described with reference to FIG. 4, and FIGS. 2 and 3 as well.

Figure 4:
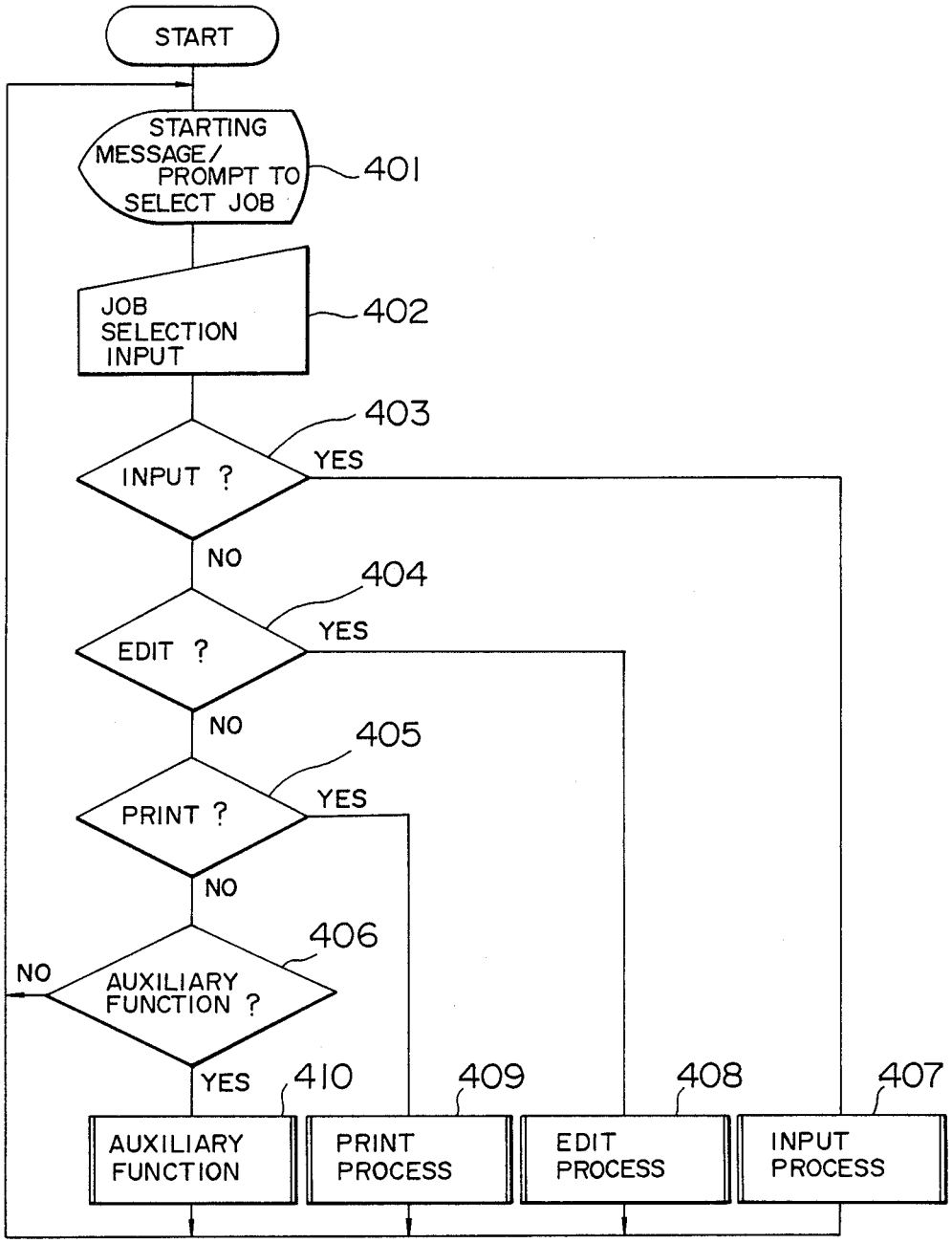
FIG. 4 is a flowchart showing the global operation of the word processor.

When the system shown in FIG. 2 is turned on, a program as shown by the flowchart of FIG. 4 stored in the flexible disk set in the FDD 24 is loaded into the program memory 253 in accordance with the program in the boot ROM 252, and then the system begins operating as a word processor in accordance with the program loaded in the program memory 253. At the same time, a CPU 111 which controls the CRT display circuit 254, as will be described later, loads a program for the CRT display operation from the flexible disk set in the FDD 24 into a memory 122 which will be described later.

In the flowchart of FIG. 4, processing step 401 displays a word processor starting message and a menu of available processings on the CRT monitor 23. Step 402 reads the menu selection input specified by the operator on the keyboard. Step 403 detects whether the specified operation is the file input operation, step 404 detects whether the specified operation is the file editing operation, step 405 detects whether the specified operation is the printing operation, and step 406 detects whether the specified operation is the auxiliary function. Consequently, the control sequence branches to any of the respective processes 407 through 410, or if the operator's specification is irrelevant to any of the above operations, the control sequence returns to step 401. The auxiliary function in FIG. 4 represents generically system functions such as copying a text file from a flexible disk to another flexible disk.

Figure 5:
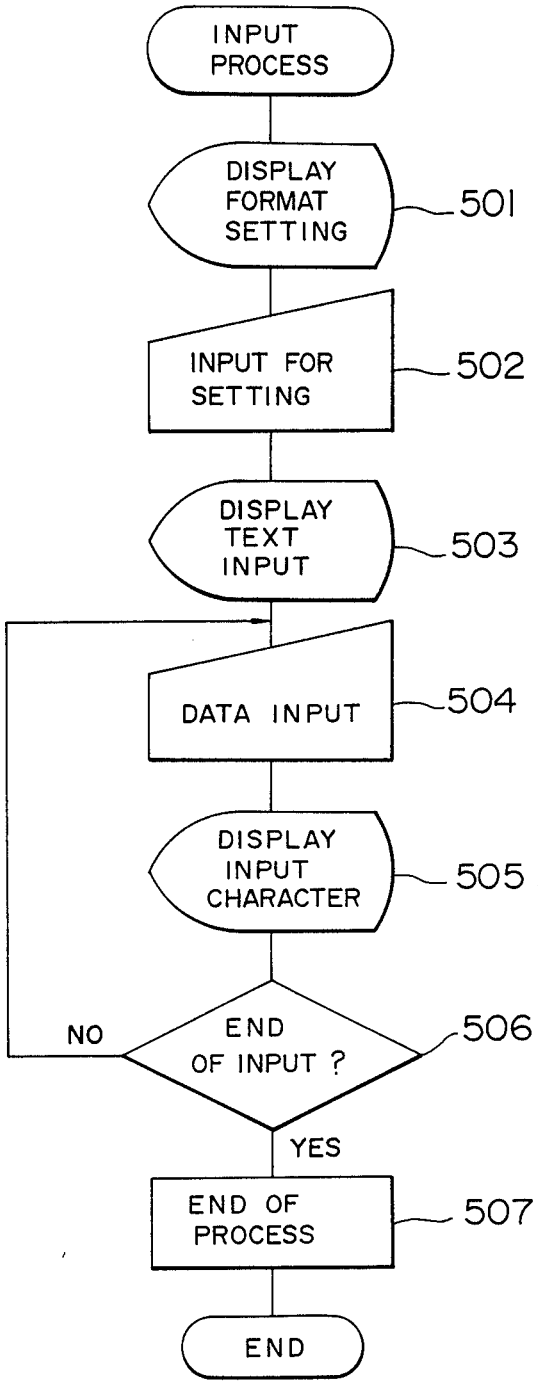
FIG. 5 is a flowchart of input process of the word processor.

When the input process 407 is selected through the operation menu selection input, the CPU 251 executes the input process program as shown by the flowchart of FIG. 5. During the input process, text data is sent in the form of commands and data to the CRT display circuit 254 over a signal line a in accordance with the input data processing program as shown in FIG. 5 stored in the program memory 253. The CRT display circuit 254 creates a display pattern, converts it into a display signal, and sends it to the CRT monitor 23 so that the data is displayed on the CRT screen. The input data process of text data is performed in accordance with data and instructions inputted by the keyboard 21.

In the flowchart of FIG. 5, processing step 501 displays the form setting items for the input text on the CRT monitor 23, and step 502 reads setting values specified by the operator on the keyboard. Step 503 displays an input screen based on the form setting. Step 504 reads input data from the keyboard 21, and step 505 displays it. Step 506 detects whether the end of data input operation has been entered. If the end of operation is not detected, the sequence returns to step 504, or if the end of operation is detected, the sequence proceeds to step 507 for the termination process and returns to the process of FIG. 4. The termination process of step 507 represents operations such as storing the input data temporarily on the flexible disk.

In the case of solely displaying characters, the CPU 251 is instructed by the program stored in the program memory 253 to provide the CRT display circuit 254 with a row of data to be displayed on the screen. Namely, the CPU 251 responds to each character input from the keyboard 21 to send a row of data, with the newly entered character being added to the end of row, to the CRT display circuit 254 through the signal line a.

Although the operator enters one character at a time, the CPU 251 and CRT display circuit 254 need to display a complete row of data, the input process by the CPU 251 and the display process by the CRT display circuit 254 must be instantaneous for the operator's comfort. These operations are repeated until the end of data input is instructed, and the entered data is displayed on the CRT monitor 23.

The end of data input entered through the keyboard 21 is detected by the CPU 251, which then executes the termination process to terminate the input process as shown in FIG. 5 and waits for the next process as shown in FIG. 4. The termination process of step 507 in FIG. 5 represents processings such as storing temporarily the entered data on the flexible disk, as mentioned previously.

The editing process 408 in FIG. 4 implements the rewriting of display data in accordance with the entry of a function key on the keyboard 21. Other processings include display for the operational instructions and their intermediate results on the CRT monitor 23.

Figure 1:
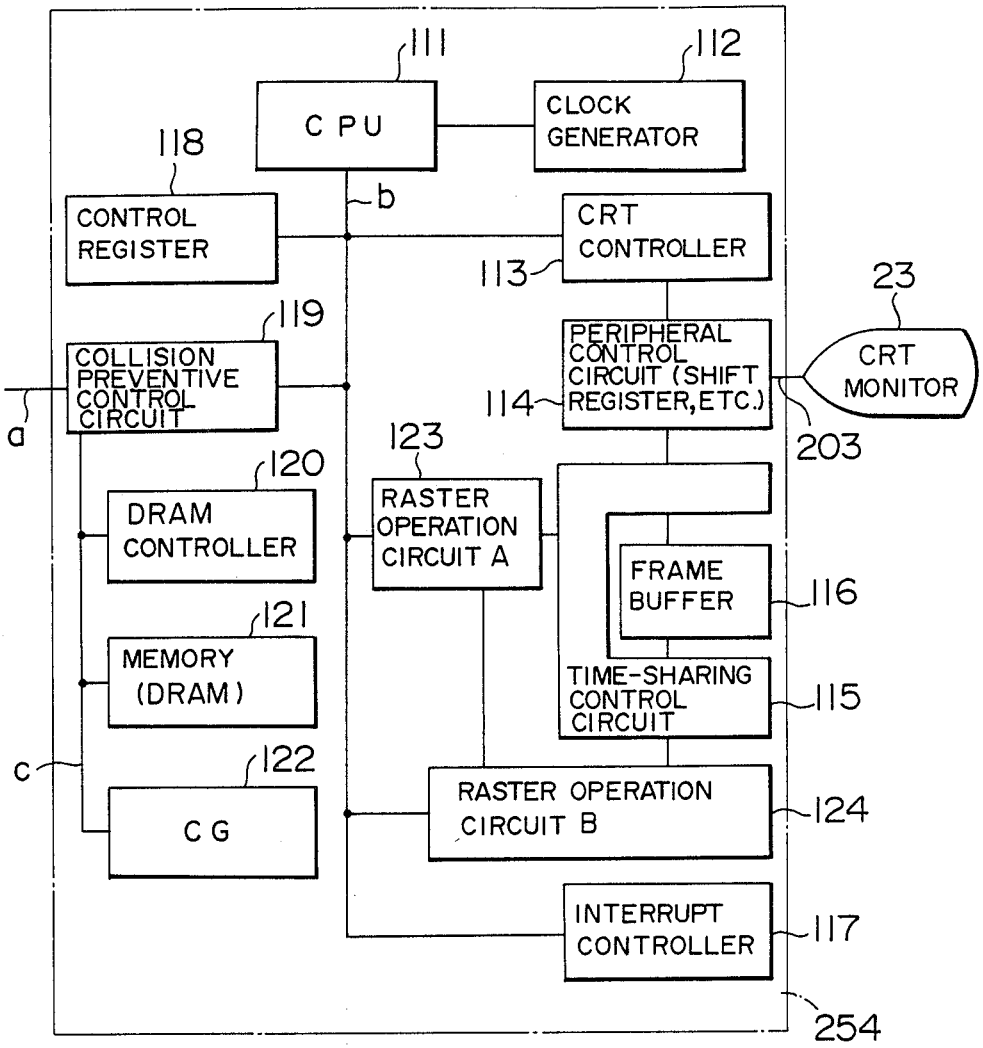
FIG. 1 is a block diagram of a CRT display unit incorporating the inventive raster operation device.

Next, the CRT display circuit 254 pertinent to the present invention will be described. FIG. 1 shows in block diagram the CRT display circuit 254 which incorporates the inventive raster operation device.

The CRT display circuit 254 shown in FIG. 1 consists of a CPU 111 (e.g., type 8086 or 8088 manufactured by Intel Corporation is suitable) which controls the overall system, a clock generator 112 which provides the necessary signals such as the clock for the CPU 111, a CRT controller 113 which produces the address signal for sequentially reading out the contents of a frame buffer 116 and also generates the synchronizing signal for controlling the CRT monitor 23, a peripheral control circuit 114 made up of a shift register which converts parallel data from the frame buffer 116 into a serial display signal and a driver which supplies the synchronizing signal from the CRT controller 113 to the CRT monitor 23, a CRT monitor 23 which receives the display signal and synchronizing signal and implements display, a time-sharing control circuit 115 which controls on a time-slice basis the access signal from the CPU 111 and the access signal from the CRT controller 113 and delivers the controlled signals to the frame buffer 116 so as to send data from the memory to the access-making components, the frame buffer 116 made of dynamic RAMs having a 128 killo-byte (64 killo-bits) by 16 bits words) capacity as a bit map, for example, each bit forming a pixel of image on the screen, an interrupt controller 117 which provides the interrupt signal for the CPU 111 to branch the control sequence in response to an event of the CPU 251 in FIG. 3 which is the host of the CRT display device 254 and events of the outside, a control register 118 which holds control information such as the shift read/write control bit, a collision prevention control circuit 119 which controls on a multiplex basis the access signal from the CPU 111 to the memory 121 and a character generator (CG) 122 which will be described later and the access signal from the CPU 251 in FIG. 3, a DRAM controller 120 which produces the multiplexed address signal to the memory 121 and controls the memory refreshing operation, a dynamic RAM (DRAM) 121 which holds data dynamically, the character generator (CG) 122 made of ROM for storing Kanji, Kana, alphabetic and numeric characters in the form of dot patterns, and a raster operation circuit A 123 and raster operation circuit B 124 located between the CPU 111 and the time-sharing control circuit 115.

The CPU 251 and CRT display circuit 254 in FIG. 3 are connected through the data signal line a, as mentioned previously. A CPU bus b connects the CPU 111, CRT controller 113, time-sharing control circuit 115, interrupt controller 117, control register 118, and collision prevention control circuit 119 in the CRT display circuit, and a memory bus sends the access signals on the signal line a and bus b on a multiplex basis to the DRAM controller 120 and CG 122.

Figure 6:
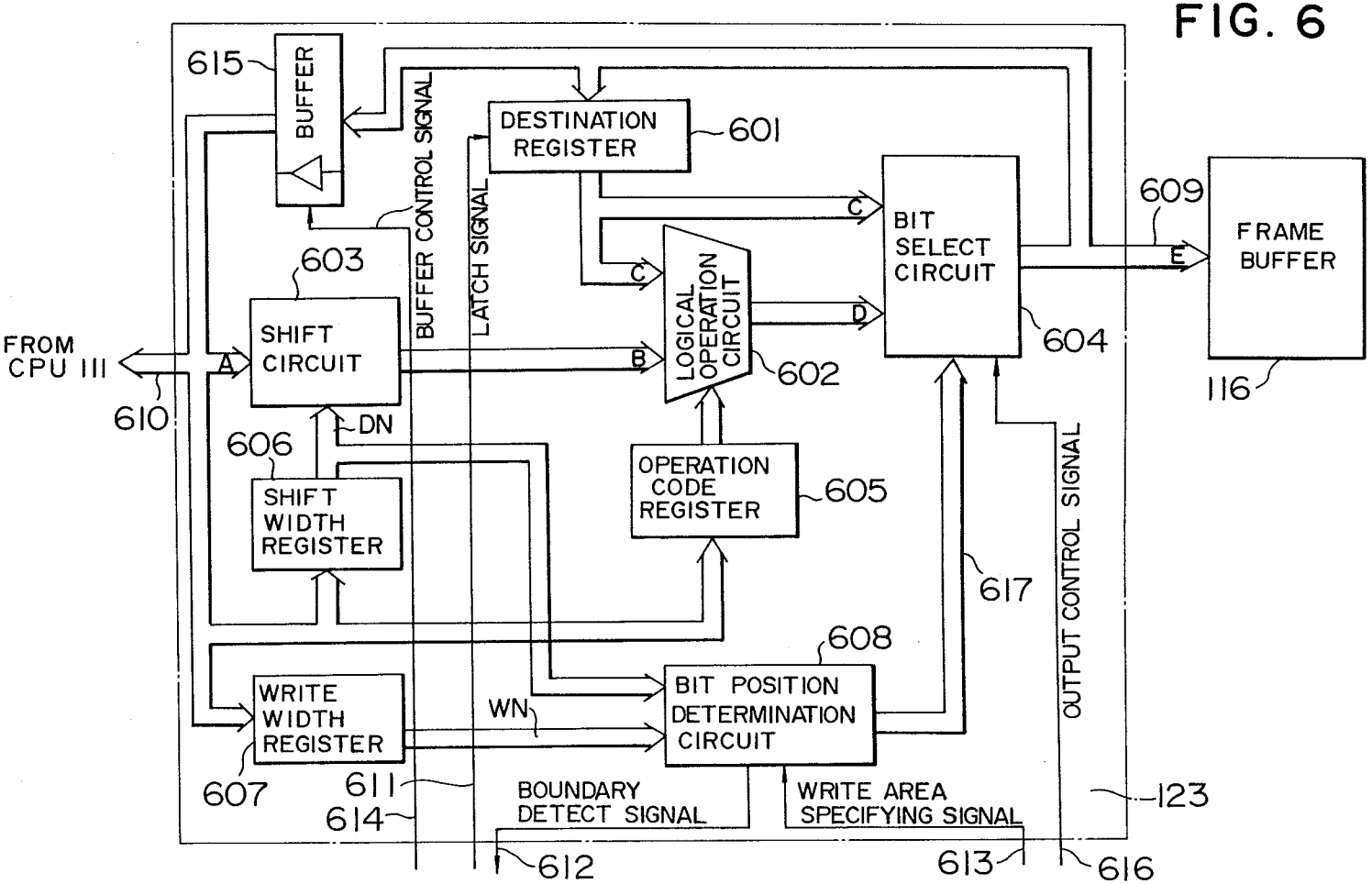
FIG. 6 is a block diagram of the raster operation circuit A shown in FIG. 1 embodying the present invention.

FIG. 6 explains the data stream from the CPU 111 to frame buffer 116 in FIG. 1, with the data bus and address bus from the time sharing control circuit 115 and peripheral control circuit 114 being omitted in the figure.

The raster operation circuit A 123 consists of a destination register 601 which latches data from the frame buffer 116, a bus buffer 615, a barrel shift circuit 603 using a data selector, a logical operation circuit 602, an operation code register 605 for specifying the type of operation implemented by the logical operation circuit 602, a bit selection circuit 604 which merges in bit units the output data from the destination register 601 with the output data from the logical operation circuit 602, a shift width register 606 which specifies the shift width measured from the load boundary to the adjacent load boundary for the writing data supplied by the CPU 111, a write width register 607 which specifies the width of data to be written, and a bit position determining circuit 608 which specifies the bit position of data to be merged from values etc. in the shift width register 606 and write width register 607 to the bit selection circuit 604. The shift width register 606, write width register 607 and operation code register 605 are present with control information from the CPU 111 through the data bus, although the paths for transferring control information and control signals to these registers are not shown in the figure.

Indicated by 610 is a data bus from the CPU 111, and 609 is a data bus from the frame buffer 116. The buffer control signal 614 and output control signal 616 are signals for enabling or disabling (in 3-states modes) the output of the buffer 615 and bit selection circuit 604, respectively. In reading out data from the frame buffer 116, the bit selection circuit 604 is disabled to output in response to a high state, for example, of the output control signal 616, while the buffer 615 is enabled to output by the buffer control signal 614 when data is read out to the CPU 111. In writing data into the frame buffer 116, the output control signal becomes a low state, for example, enabling the bit selection circuit 604 to output. The latch signal 611 is to latch data on the data bus 609. Data on the data bus 609 is latched in the register 601 at the falling edge of the signal 611. The boundary check signal 612 checks whether the data which has been specified for writing from the CPU 111 into the frame buffer 116 lies across the word boundary of the frame buffer 116. The write area specification signal 613 is a signal which changes the determination condition of the bit position determination circuit 608 (the signal will be described in detail later).

Figure 7:
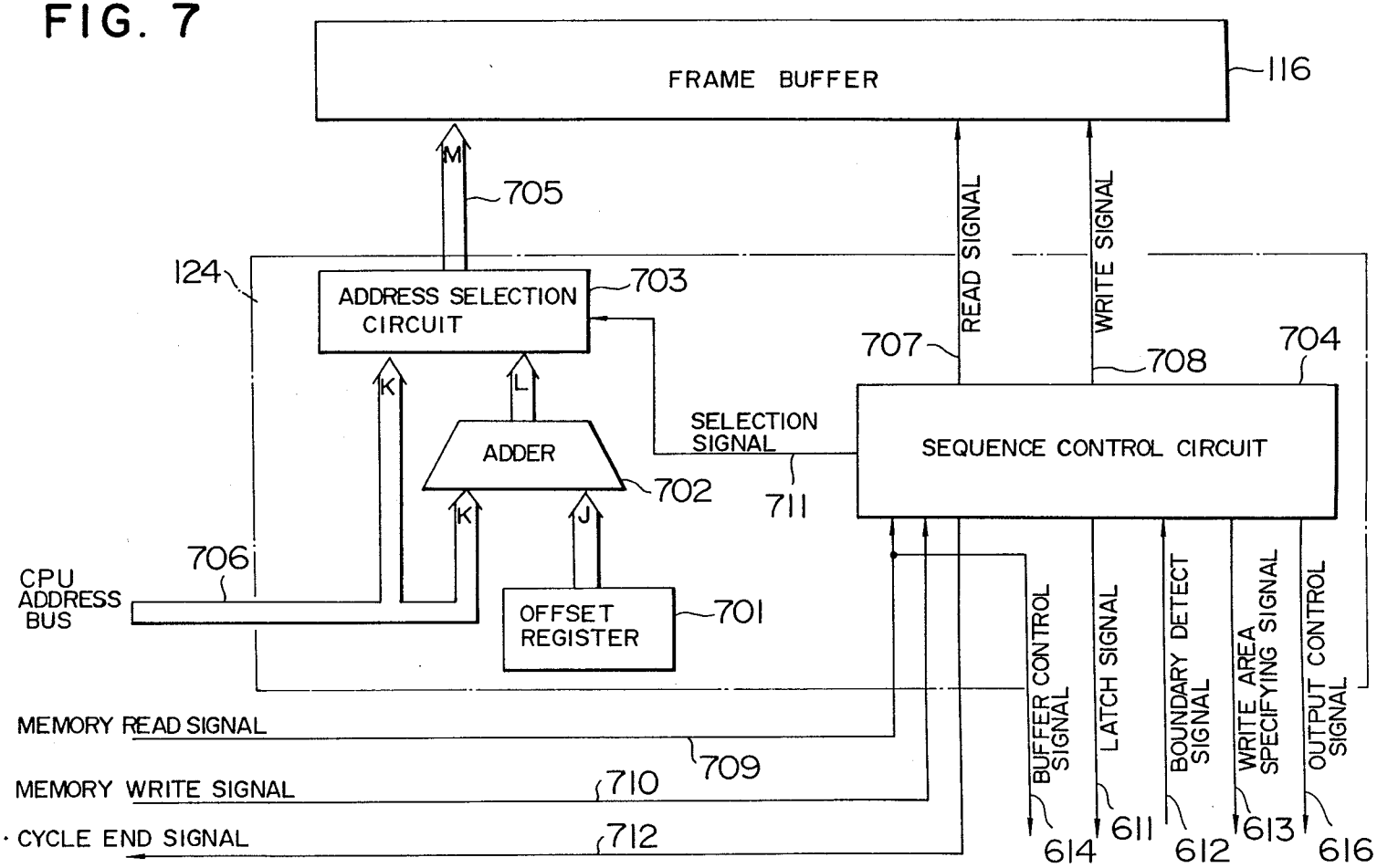
FIG. 7 is a block diagram of the raster operation circuit B shown in FIG. 1 embodying the present invention.

FIG. 7 is a diagram explaining the flow of address signal and control signals from the CPU 111 to the frame buffer 116 in FIG. 1, although the data bus and address bus from the time-sharing control circuit 115 and peripheral control circuit 114 are omitted as in FIG. 6.

The raster operation circuit B 124 consists of an offset register 701 which holds the difference between an arbitrary address of the frame buffer 116 and the next address adjacent in the word boundary direction from the previous address, an adder 702 which produces the next address adjacent in the word boundary direction with respect to the address which has been specified for writing, by adding address J held in the offset register 701 to address K of the frame buffer 116 specified for data writing by the CPU 111, an address selection circuit 703 which selects one of the address specified with the selection signal 711 by the CPU 111 or the address produced by the adder 702 and supplies the selected address to the frame buffer 116, and a sequence control circuit 704 which controls the operation of the raster operation circuit A 123 and raster operation circuit B 124 (the arrangement of the sequence control circuit 704 will be described later).

The offset register 701 is preset to an offset address by the CPU 111 through the data bus, although the path for transferring information to this register and the control signals are omitted in the figure.

The memory read signal 709 and memory a data signal 710 are a data reading command signal and data writing command signal, respectively, for the frame buffer 117 produced by the CPU 111 and its peripheral circuit (not shown). The cycle end signal 712 is a signal indicating the end of data write cycle to the CPU 111. The read signal 707 and write signal 708 are a data read command signal and a data write command signal, respectively, issued by the sequence control circuit 704 to the frame buffer 116. Indicated by 706 is an address bus from the CPU 111, and 705 is an address bus extending from the address selection circuit 703 to the frame buffer 116.

Figure 9:
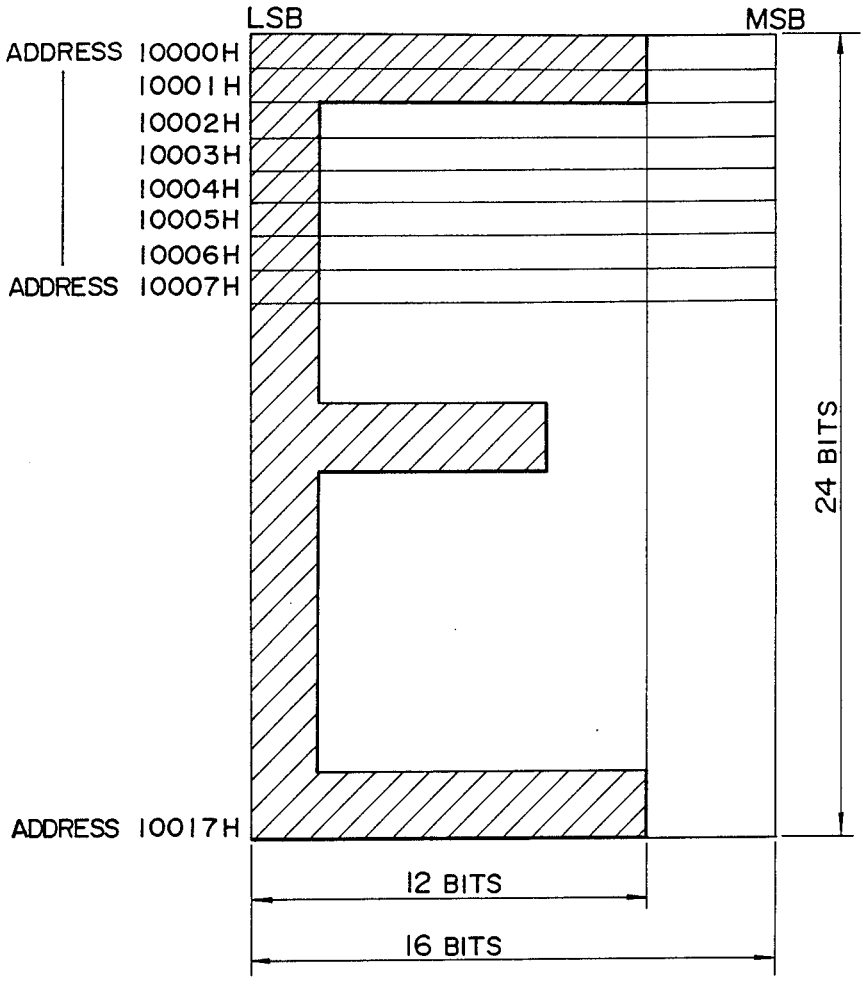
FIG. 9 is a diagram showing the format of data stored in the character generator shown in FIG. 1.

FIG. 9 shows the data storage format in the character generator 122 in FIG. 1, illustrating a halfwidth character "E" in 12 (horizontal) by 24 (vertical) dots configuration. Each character dot pattern is stored left-justified in a memory area of one word (16 (horizontal) by 24 (vertical) dots). The word has LSB at the leftmost bit position and MSB at the rightmost bit position. The memory is addressed in the ascending order from top to bottom on the drawing, and addressed wordwise instead of bytewise in FIG. 9 for the simplicity of explanation.

Figure 10:
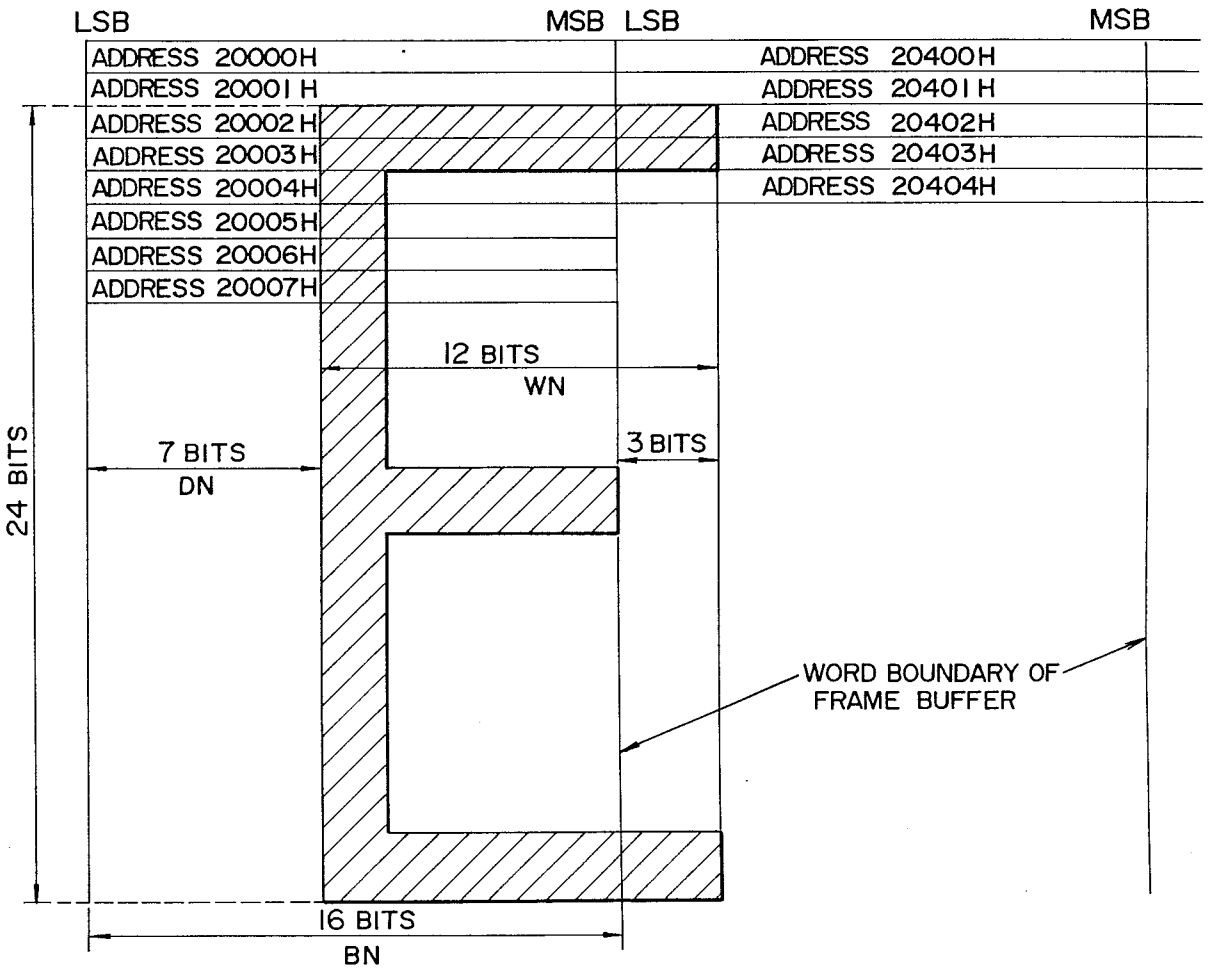
FIG. 10 is a diagram showing the format of data stored in the frame buffer shown in FIG. 6.

FIG. 10 shows the data storage format in the buffer 116, and also shows the half width character "E" of FIG. 9 which in this case is laid in an area starting at address 20002H of the frame buffer 116 through 7-bit shifts from the word boundary. Also in FIG. 10 the frame buffer is addressed wordwise by the same reason as FIG. 9. Since the frame buffer 116 has continuous addressing from top to bottom in the vertical direction, an address immediately after the word boundary has an address distance from its left-adjacent address equal to the vertical length of the frame buffer 116, i.e., in the example of FIG. 10 two neighboring addresses across the word boundary has an address distance of 400H (H indicates an hexadecimal number).

Figure 11:
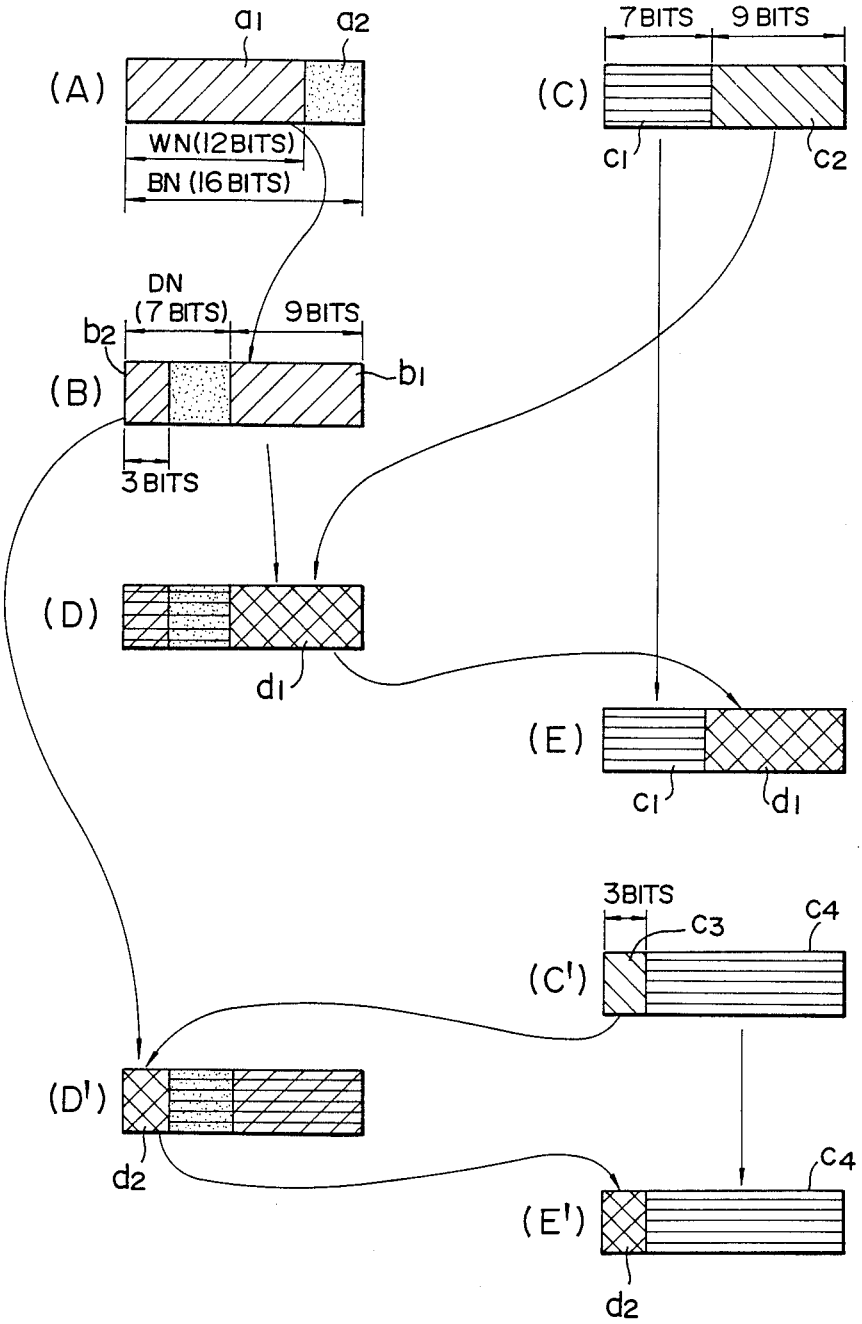
FIG. 11 is a diagram explaining the operation of the raster operation processing circuit shown in FIG. 6.

FIG. 11 is a diagram explaining the data stream in the raster operation circuit A 123 of FIG. 6. Data indicated by (A) through (E) correspond to data on buses A through E in FIG. 6.

Figure 12:
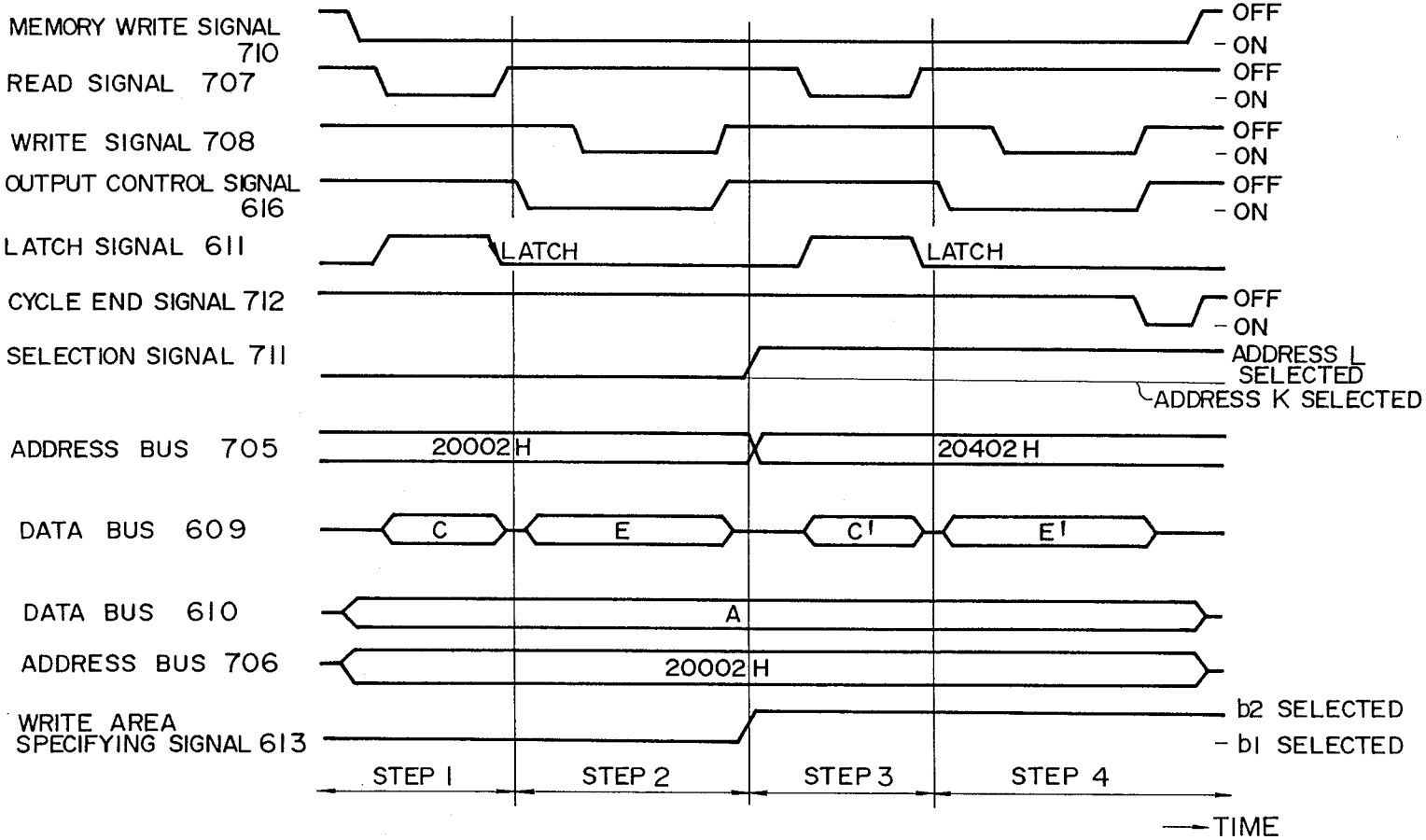
FIG. 12 is a timing chart of various signals used in the raster operation process shown in FIG. 11.

FIG. 12 shows the data writing sequence in read-modify-write mode implemented by the sequence control circuit 704 when the CPU 111 commands the frame buffer 116 to write data (using the memory write signal 710).

The following describes using FIGS. 6 and 7 and FIGS. 9–12 the system operation when the dot pattern of character "E" shown in FIG. 9 is expanded in the frame buffer 116 as shown in FIG. 10. Expansion of the dot pattern of character "E" is carried out in such a way that the CPU 111 reads out each word of dot pattern from the character generator 122 sequentially starting at address 10000H and writes it into the frame buffer 116 starting at address 20002H repeatedly (24 times in the example of FIG. 9) for the complete character. In expanding the dot pattern of a character from the character generator 122 into the frame buffer 116, of the case of superimposing a character read out of the character generator on data stored in the frame buffer, it is necessary for the CPU 111 to have a logical operation (OR) for the data to be written into the frame buffer 116 and the data stored in the frame buffer 116, and this logical operation is performed by the logical operation circuit 602 in FIG. 6.

As in this example, if data from the CPU 111 lies across the word boundary of the frame buffer 116, the data writing takes two cycles. For example, when data in address 10000H of the character generator 122 is written into address 20002H of the frame buffer 116, where the data write width WN is 12 bits, data shift width DN is 7 bits, and the 1-word bit width BN of the frame buffer 116 is 16 bits, then 3 bits (12 bits+7 bits−16 bits) of data is left unwritten in address 20002H and it must be written in address 20402H which adjoins the address 20002H in the word boundary direction (horizontal direction). In this case, the number of bits of data written in address 20002H is 9 bits (16 bits−7 bits).

Judgement of as to whether data to be written in the frame buffer 116, as directed by the CPU 111, lies across the word boundary is based on the following expression.

$$BN-DN<WN \quad (1)$$

If the expression (1) is disagreed, data writing across the word boundary does not occur, or if the expression (1) is agreed, data writing across the word boundary occurs. This judgement is implemented by the bit position determination circuit 608. The parameter BN represents the bit width of data on the data buses 609 and 610 in FIG. 6 and it is specific to the system. In this embodiment, the data bit width BN is 16 bits.

The registers shown in FIGS. 6 and 7 are written in advance necessary information by the CPU 111 before dot data of character is expanded in the frame buffer. Namely, a shift width DN (7 bits in this embodiment) is set to the shift width register 606, a bit width WN (12 bits in this embodiment) of source data to be written in the frame buffer 116 is set in the write width register 607, a code data indicating the type of logical operation is set in the operation code register 605, and a difference J of addresses adjoining in the word boundary direction of the frame buffer 116 is set in the offset register 701. In response to data setting in the registers 606 and 607, the bit position determination circuit 608 produces the boundary judgement signal 612 and mask data 617 accordingly, as will be described later. When data J is set in the register 701, the adder 702 adds the data J to the address from the CPU 111 and delivers the result to the address selection circuit 703.

In FIG. 11, (A) shows data read out by the CPU 111 from the starting address (10000H) for character "E" in the character generator 122. The data is made up of dot data a1 to be written in the frame buffer 116 and dot data a2 which does not relate to writing. In order for the CPU 111 to have a write operation for the data in address 20002H of the frame buffer 116, the address 20002H is set to the address bus 706 and the data (A) to the data bus 610, and the memory write signal 710 is activated. Receiving the memory write signal 710, the sequence control circuit 704 executes the four steps shown in FIG. 12.

As step 1, the selection signal 711 is made low, for example, to control the address selection circuit 703 so that address K (i.e., the address value on the address bus 706 of CPU 111) is paced on the address bus 705 in FIG. 7. At the same time, the read signal 707 is activated to direct the frame buffer 116 to read out data. The destination data read out of the frame buffer 116, starting at address 20002H, (shown by (C) in FIG. 11) is latched at the end of step 1 through the data bus 609 in FIG. 6 by the control for the latch signal 611. During the reading process for the data from the frame buffer 116, the data (A) placed on the data bus 610 by the CPU 111 is shifted by 7 bits by the shift circuit 603 (shown by (B) in FIG. 11), and undergoes the logical operation with data (B) and (C) by the logical operation circuit 602, and data shown by (D) in FIG. 11 is obtained. The logical operation circuit 602 is to perform a logical operation in operational mode specified by the operation code set in the operation code register 605 by the CPU 111. Operational modes include logical sum, logical produce, exclusive logical sum, etc., and the mode is logical sum in this example. In the data (B) in FIG. 11, b1 corresponds to data to be written in address 20002H, and b2 corresponds to data to be written in address 20402H which is adjacent to the address 20002H in the word boundary direction. In the data (D), data to be written finally in address 20002H is 9 bits of dl, and for the remaining 7 bits, cl of data (C) which has been stored initially in address 20002H of frame buffer 116 needs to be rewritten in address 20002H. Therefore, it is necessary to merge the data (C) and (D) into data (E) by the bit selection circuit 604 in FIG. 6 and write the result in address 20002H. This bit merging process is directed by the bit position determination circuit 608. The bit position determination circuit 608 tests whether or not data writing takes place across the word boundary (FIG. 10) basing on expression (1).

Figure 13:
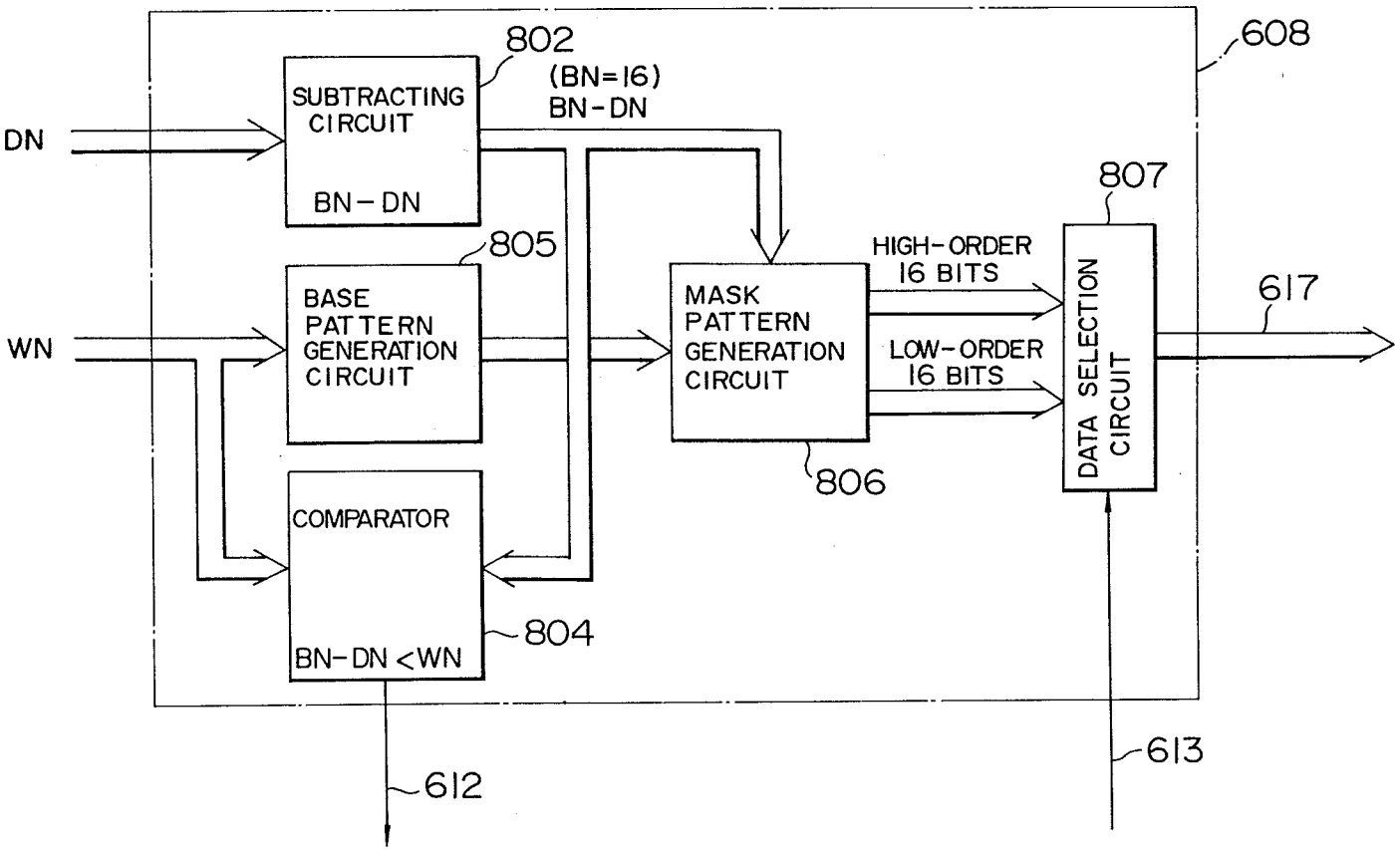
FIG. 13 is a block diagram of the bit position determination circuit shown in FIG. 6 embodying the present invention.

FIG. 13 shows the arrangement of the bit position determination circuit 608. The bit position determination circuit 608 includes a subtracting circuit 802, a comparator 804, a base pattern generating circuit 805, a mask pattern generating circuit 806, and a data selecting circuit 807. The subtracting circuit 802 receives the output DN of the shift width register 606 to calculate the difference from the value of BN which has been given in advance, and delivers the result BN−DN to the comparator 804 and mask pattern generating circuit 806. The value of BN is 16 in this embodiment. The comparator 804 compares the input BN−DN from the subtracting circuit 802 with the input WN from the write width register 607 for implementing the judgement of expression (1), and provides the result of judgement as a boundary check signal 612. In the case of BN−DN smaller than WN, the signal 612 is high, for example, indicating that data writing takes place across the word boundary, while in the case of BN−DN larger than or equal to WN, the signal is low, for example, indicating that data writing across the word boundary does not take place.

The base pattern generating circuit 805 responds to the input WN from the shift width register 606 to provide the 16-bit data (p0–p15) shown in FIG. 14A to the mask pattern generating circuit 806. Basing on the 16-bit data (p0–p15) and BN−DN from the subtracting circuit 802, the mask pattern generating circuit 806 produces the low-order 16-bit data (bit0–bit15) and high-order 16-bit data (bit16–bit31) shown in FIG. 14B and delivers them to the data selecting circuit 807. The data selecting circuit 807 provides the low-order 16 bits of input data from the mask pattern generating circuit 806 for the bit selecting circuit 604 when the write area specifying signal 613 is low, i.e., data write mode in steps 1 and 2, or provides high-order 16 bits of the data for the bit selecting circuit 604 when the signal 613 is high, i.e., data write mode in steps 3 and 4. The bit selecting circuit 604 is to merge bitwise the input (C) from th destination register 601 with the input (D) from the logical operation circuit 602 in accordance with bit information of the 16-bit data sent from the data selecting circuit 807, and provides the result for the frame buffer. More specifically, it implements data selection depending on the bit values of the 16-bit data from the data selecting circuit 807, i.e., it selects bit data from the logical operation circuit 602 in response to 1's bit at certain bit position, or selects bit data from the corresponding destination register 601 in response to a 0's bit at certain bit position. By selecting bit data depending on the value of each bit, 16-bit output data is formed.

In case data writing does not take place across the word boundary, high-order 16 bits in FIG. 14B have a bit pattern of 0's string, or in case data writing takes place across the word boundary, some 1's bits are included in the bit pattern of the high-order 16 bits. The bit positions of the l's bits correspond to the bit positions at which data of the adjacent address must be rewritten when data writing across the word boundary takes place. On this account, the bit position determination circuit 608 provides the loworder 16 bits shown in FIG. 14B for the bit selecting circuit 604 to specify the bit positions to be rewritten when data writing does not cross the word boundary. Namely, the bit selecting circuit 604 is directed such that only bits d1 corresponding to the writing data width shifted by DN, i.e., BN−DN, are rewritten so that the rewritten data (E) is placed on the data bus 609.

The data placed on the data bus 609 is written in address 20002H of frame buffer in response to the write signal 708 provided by the sequence control circuit 704. Upon completion of data writing, the cycle end signal 712 becomes active, and the end of write cycle is indicated to the CPU 111 (step 2). In this case, the data write cycle from CPU 111 to frame buffer 116 completes in two steps of step 1 and step 2 in FIG. 12.

Figure 14C:
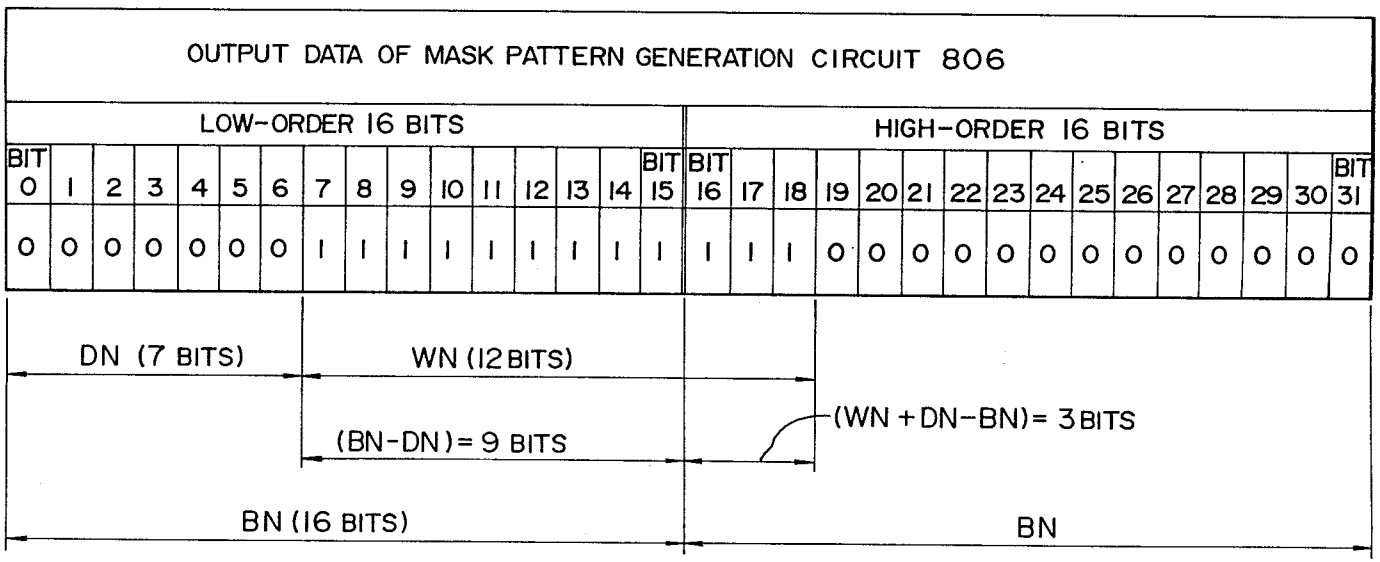

As described above, this example is the case of data writing across the word boundary, and the output from the mask pattern generating circuit 806 in correspondence to FIG. 14B is as shown in FIG. 14C. In step 2, the bit position determination circuit 608 provides low order 16 bits of data in response to a low write area specifying signal 613, and directs the bit selecting circuit 604 to rewrite only a bit section corresponding to BN−DN=16 bits−7 bits=9 bits (d1 of data (D) in FIG. 11), and the data is written in address 20002H of the frame buffer 116 in response to the write signal 708, as in the preceding case.

In case of data writing across the word boundary, the result of judgement is indicated by the bit position determination circuit 608 to the sequence control circuit 704 in the form of the boundary check signal 612. In this case, steps 1 and 2 are followed by steps 3 and 4 carried out by the sequence control circuit 704. For the transition from step 2 to step 3 and step 4, the sequence control circuit 704 changes the state of the selection signal 711 and write area specifying signal 613 from low to high, for example. The selection signal 711 is controlled so that address L (output of the adder 702) is placed on the address bus 705, and at this time the address bus 705 is given by the CPU 111 the address adjacent on the right of address 20002H, i.e., address 20402H adjacent in the word boundary direction, indicated to the frame buffer 116 for data writing. The write area specifying signal 613 changes its state from low to high, directing the bit position determination circuit 608 in FIG. 6 to rewrite data (data at position b2 in data (B) in FIG. 11) to be written in address 20402H. Namely, the output of the bit position determination circuit 608 provides the high-order 16-bit data shown in FIG. 14C, and directs the bit selection circuit 604 to rewrite only a bit section corresponding to WN+DN−BN=12 bits+7 bits−16 bits=3 bits.

In step 3, data from the frame buffer 116 is latched in the destination register 601, and the latched data at this time becomes data of address 20402H (data (C') in FIG. 11). The logical operation circuit 602 in FIG. 6 takes logical sum for the data (B) and (C'), resulting in data (D') in FIG. 11. The final data written in the frame buffer 116 are merged by the bit selection circuit 604 in FIG. 6, resulting in data with the 3-bit d2 being rewritten as shown by data (E') in FIG. 11. This final data is written in address 20402H of frame buffer in step 4, and the sequence control circuit 704 indicates the end of write cycle to the CPU 111 in the form of the cycle end signal 753. For the remaining addresses (20003H and so on) of the dot pattern of character "E", the prescribed dot pattern expansion from the character generator 122 into the frame buffer 116 takes place in the similar sequence.

Figure 8:
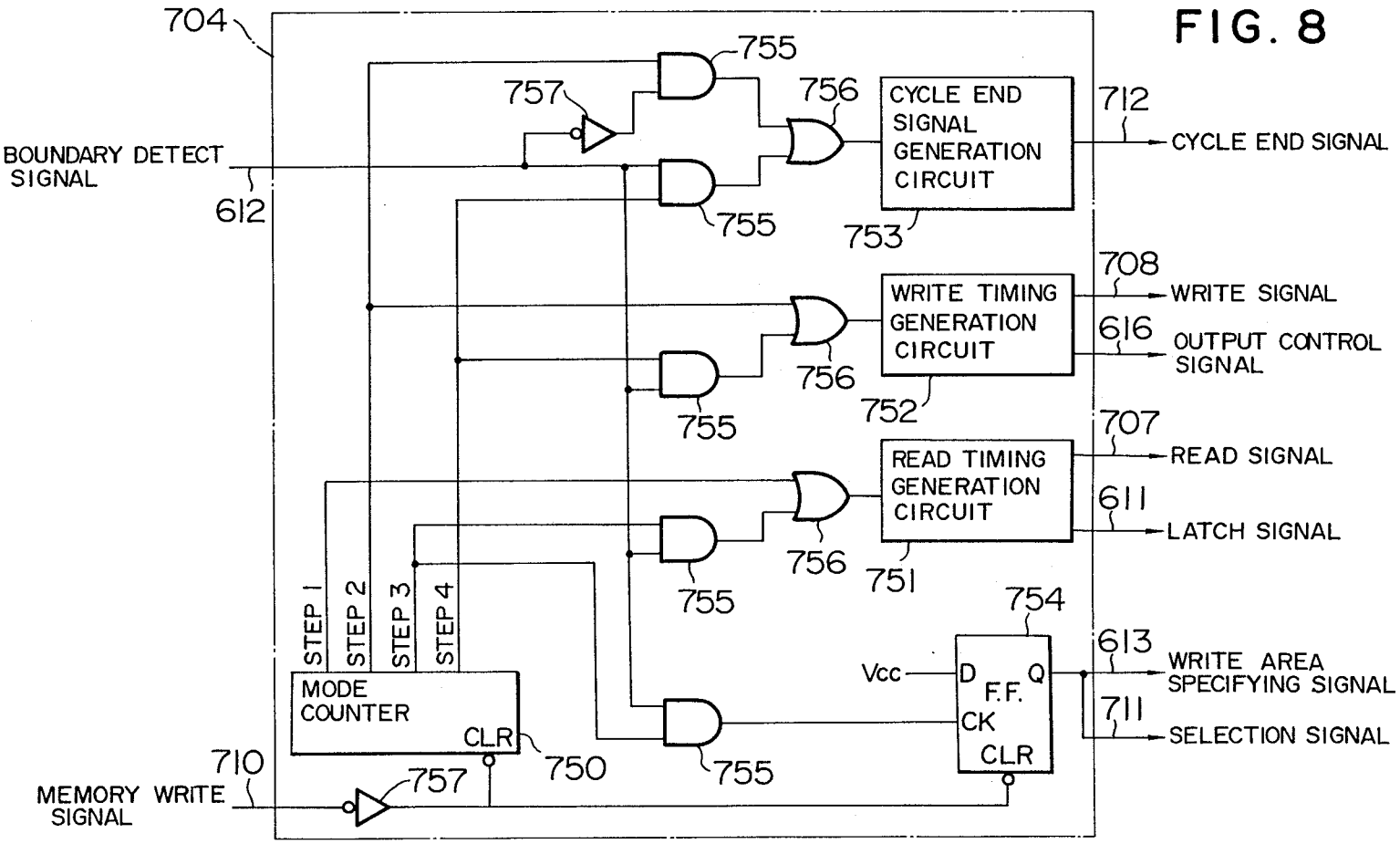
FIG. 8 is a block diagram of the sequence control circuit shown in FIG. 7 embodying the present invention.

FIG. 8 shows in block diagram the arrangement of the sequence control circuit 704 shown in FIG. 7. In the figure, indicated by 750 is a mode counter which specifies one of steps 1 through 4 in FIG. 12. Indicated by 751 and 752 are read timing generation circuit and write timing generation circuit which produce control signals for writing data from the CPU 111 into the frame buffer 116 in read-modify-write mode. Indicated by 753 is a cycle end signal generation circuit which produces the cycle end signal 712 for indicating to the CPU 111 that the data write cycle has completed. Indicated by 754 is a flip-flop which produces the write area specifying signal 613 and selection signal 711, and it makes an output transition from low to high at the rising edge of the CK input. Indicated by 755 are AND gates, 756 are OR gates and 757 are inverters.

FIG. 8 shows only circuit blocks related to this invention, i.e., he circuit section for memory writing from CPU 111 to frame buffer 116, and the circuit blocks related to memory reading are omitted.

In FIG. 8, with the memory write signal 710 being in inactive state, the mode counter 750 and flip-flop 754 are cleared. When the memory write signal 710 has become active, the mode counter 750 operates to produce the signal indicative of step 1, as shown in the timing chart of FIG. 12. In response to this signal, the read timing generation circuit 751 operates, causing the read signal 707 and latch signal 611 to become active.

At the timing of step 2, the mode counter 750 issues the signal indicative of step 2, and in this case the write timing generation circuit 752 causes the write signal 708 and output control signal 616 to become active (i.e., low level for example). In case the data, which has been specified for writing from CPU 111 into frame buffer 116, does not cross the word boundary of the frame buffer 116, the boundary check signal 612 provided by the bit position determination circuit 608 is inactive (low level), and consequently the cycle end signal generation circuit 753 operates at step 2 to indicate the end of data write cycle to the CPU 111 with the cycle end signal 712. The timing chart of FIG. 12 shows the case of write-specified data crossing the word boundary (the boundary check signal 612 is active (high)), and in this case the cycle end signal 712 does not become active in step 2 and the mode counter 750 advances to step 3. After the mode counter 750 has advanced to step 3, the flip-flop 754 is set and the write area specifying signal 613 and selection signal 711 are varied to direct the circuit sections to generate the address adjacent in the word boundary direction and alter the bit position for the writing data, in order to rewrite the data b2 which has been left unwritten in step 2. In steps 3 and 4, the read signal 707, latch signal 611, write signal 708 and output control signal 616 change their states as in steps 1 and 2. At the end of step 4, the cycle end signal 712 is generated, and the write cycle completes.

Although in the illustrated embodiment the circuit arrangement shown in FIG. 8 is used as the sequence control circuit 704, other circuit arrangement which realizes the sequence shown by the timing chart of FIG. 12 can also be used.

Figure 15A:
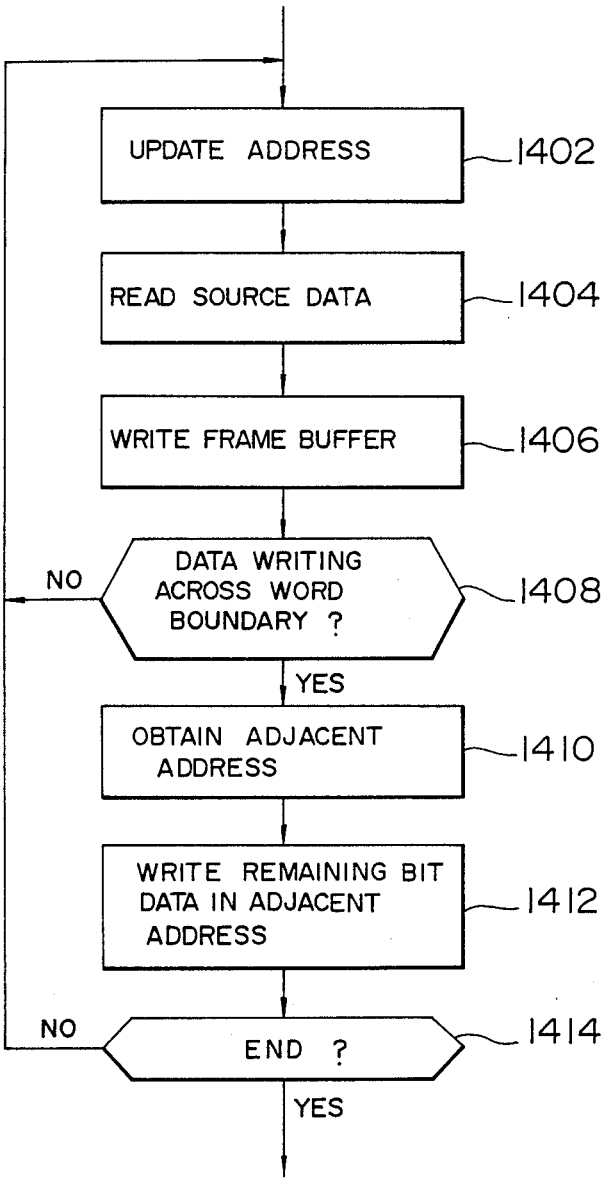
FIG. 15A is a flowchart of the operation process implemented by the conventional raster operation circuit.
Figure 15B:
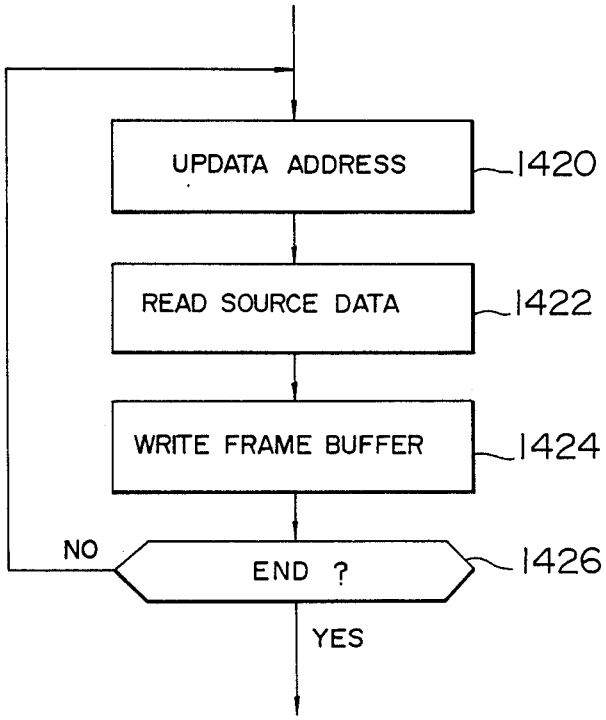
FIG. 15B is a flowchart of the operation process implemented by the inventive raster operation circuit.

FIG. 15A shows the flowchart of the character dot pattern expansion process implemented by the conventional raster operation circuit, and FIG. 15B shows the flowchart of the character dot pattern expansion process implemented by the inventive raster operation circuit. The comparison of FIG. 15A and FIG. 15B reveals that the software process based on the present invention eliminates steps 1408 through 1412 in the conventional process and it significantly simplifies the process as compared with the conventional one.

As will be appreciated from the above description for the illustrated embodiment, this invention enables direct data writing on a hardware basis without the need of software-based recognition as to whether writing data lies across the word boundary of frame buffer, whereby the inventive raster operation device can realize a fast display process.

I claim:

1. A raster operation device comprising:

data transfer means which generates addresses of word data and transfer position of said data, and transfers said data to said transfer position;

a memory for storing said data by being accessed wordwise;

reading means which reads data out of said memory;

shift width specifying means which specifies a writing location in said memory for said data in terms of a shift width from a word boundary of said memory;

data shift means which is located on the data transfer path from said transfer means to said memory for shifting data from said transfer means in accordance with shift width data provided by said shift width specifying means;

means for specifying the bit width of data which is written from said transfer means to said memory;

word boundary checking means which discriminates as to whether or not data is written across the word boundary of said memory basing on the shift width provided by said shift width specifying means, the bit width provided by said bit width specifying means and the bit width of word of said memory, and produces a first signal or second signal when the data is found to cross the word boundary or not cross the word boundary, respectively;

means for taking a logical operation between the writing data which has been shifted by said data shift means and the data which has been read out of said memory;

bit converting means which writes the data read out of said memory into said memory by replacing specified bits of data with data produced as a result of said logical operation;

address generation means which calculates a next address of said memory adjacent in the word boundary direction basing on the address generated by said data transfer means, and makes access to said memory by providing selectively one of said generated address and said next address; and control signal generation means which issues control signals to said reading means, bit converting means and address generation means so that said reading means reads out data accessed by said address generation means from said memory in the former half of data writing cycle of said memory implemented by said transfer means and said bit converting means writes data into said memory in the latter half of data writing cycle, in read-modify-write mode;

said control signal generation means responding to the generation of said second signal by said word boundary detection means to provide said address generation means with a first address control signal so as to address said memory, thereby controlling the writing of the data in read-modify-write mode, and respond to the generation of said first signal by said word boundary detection means to provide said address generation means with the first address control signal so as to address said memory, thereby controlling the writing of the data in read-modify-write mode, and thereafter provide said address generation means with a second address control signal so as to access to the next address of said memory, thereby controlling in read-modify-write mode the writing of data which has crossed the word boundary by the shift operation.

2. A raster operation device according to claim 1, wherein said address generation means comprises a register which holds a difference of address values between an arbitrary address of said memory and a next address adjacent in the word boundary direction to said arbitrary address, an adder which calculates the sum of an address provided by said transfer means and said difference of address values provided by said register, and an address selection circuit which responds to said first and second control signals from said control signal generation means to select the address from said transfer means or the summed address from said adder, thereby accessing to said memory.

3. A raster operation device according to claim 1, wherein said word boundary checking means produces said first signal in response to a bit width WN provided by said bit width specifying means, a shift width DN provided by said shift width specifying means and a bit width BN of word of said memory in a relationship satisfying expression $BN-DN<WN$, or produces said second signal in response to the values WN, DN and BN in a relationship unsatisfying said expression.

4. A raster operation device according to claim 1 further comprising mask pattern generation means which provides said bit converting means with a mask pattern in synchronism with said first and second address control signals provided by said control signal generation means, basing on a bit width WN provided by said bit width specifying means, a shift width DN provided by said shift width specifying means and a bit width of word BN of said memory, said bit converting means merging data resulting from said logical operation with data read out of said memory.

5. A raster operation device according to claim 4, wherein said mask pattern generation means generates a mask pattern basing on calculation $BN-DN$ in synchronism with said first address control signal, operates on said bit converting means to replace bits equal in number to $BN-DN$ of data read out of said memory with data resulting from said logical operation, generates a mask pattern basing on calculation $WN+DN-BN$ in synchronism with said second address control signal, and operates on said bit converting means to replace bits equal in number to $WN+DN-BN$ of data read out of said memory with data resulting from said logical operation.

* * * * *